US008201585B2

(12) United States Patent
Nomura et al.

(10) Patent No.: US 8,201,585 B2
(45) Date of Patent: Jun. 19, 2012

(54) METHOD AND APPARATUS FOR FILLING COATING MATERIAL

(75) Inventors: Takao Nomura, Aichi (JP); Shigeyoshi Inada, Aichi (JP); Noriyuki Achiwa, Aichi (JP); Takanobu Mori, Aichi (JP); Kengo Honma, Aichi (JP); Akira Kato, Aichi (JP); Yasushi Ogawa, Aichi (JP)

(73) Assignees: Trinity Industrial Corporation, Aichi (JP); Toyota Jidosha Kabushiki Kaisha, Aichi (JP)

( * ) Notice: Subject to any disclaimer, the term of this patent is extended or adjusted under 35 U.S.C. 154(b) by 976 days.

(21) Appl. No.: 11/915,644

(22) PCT Filed: Jun. 8, 2006

(86) PCT No.: PCT/JP2006/311493

§ 371 (c)(1),
(2), (4) Date: Mar. 17, 2008

(87) PCT Pub. No.: WO2006/132305

PCT Pub. Date: Dec. 14, 2006

(65) Prior Publication Data

US 2009/0277530 A1 Nov. 12, 2009

(30) Foreign Application Priority Data

Jun. 9, 2005 (JP) ..... 2005-169416

(51) Int. Cl.
*B05C 11/00* (2006.01)

(52) U.S. Cl. ..... 141/20.5; 141/2; 141/10; 141/95; 141/317; 901/43; 118/50

(58) Field of Classification Search ..... 141/2, 10, 141/20.5, 95, 114, 313–317; 901/43; 239/3, 239/690; 118/50
See application file for complete search history.

(56) References Cited

U.S. PATENT DOCUMENTS

| | | | | |
|---|---|---|---|---|
| 4,543,649 | A * | 9/1985 | Head et al. | 367/96 |
| 5,326,031 | A * | 7/1994 | Konieczynski | 239/3 |
| 5,882,735 | A | 3/1999 | Takeuchi | |
| 6,253,800 | B1 * | 7/2001 | Yoshida et al. | 141/18 |
| 6,589,342 | B2 * | 7/2003 | Attinoto et al. | 118/308 |

(Continued)

FOREIGN PATENT DOCUMENTS

| | | |
|---|---|---|
| CN | 1522361 | 8/2004 |

(Continued)

OTHER PUBLICATIONS

English language Abstract of JP 2005-87810.

(Continued)

*Primary Examiner* — Gregory Huson
*Assistant Examiner* — Nicolas A Arnett
(74) *Attorney, Agent, or Firm* — Greenblum & Bernstein, P.L.C.

(57) ABSTRACT

According to the present invention, even though the paint is filled or discharged repetitively to or from the paint bag (5), so that bursting of a coating bag (5) or lack of coating material during coating are not caused by accumulation of error between the filling amount and the using amount.

That is, before a predetermined amount of the coating material is supplied to the coating material bag (5), the remaining coating material in the coating material bag (5) is extruded to empty it, since the coating material bag (5) is squashed by the pressure of fluid which was supplied to the hydraulic fluid chamber (6) outside of the bag.

8 Claims, 4 Drawing Sheets

U.S. PATENT DOCUMENTS

| | | | | |
|---|---|---|---|---|
| 6,612,345 | B1 | 9/2003 | Hosoda et al. | |
| 6,742,722 | B2 * | 6/2004 | Hosoda et al. | 239/305 |
| 6,896,399 | B2 | 5/2005 | Nomura et al. | |
| 6,935,366 | B2 * | 8/2005 | Ciarelli et al. | 137/565.01 |
| 7,014,713 | B2 * | 3/2006 | Nakane | 118/300 |
| 7,156,045 | B2 | 1/2007 | Ueno et al. | |
| 7,908,994 | B2 * | 3/2011 | Herre et al. | 118/300 |
| 2003/0226354 | A1 * | 12/2003 | Nippert et al. | 60/454 |
| 2004/0244494 | A1 | 12/2004 | Woest | |
| 2005/0076832 | A1 | 4/2005 | Nakane | |
| 2005/0092238 | A1 | 5/2005 | Ueno et al. | |
| 2006/0177592 | A1 | 8/2006 | Takebe et al. | |
| 2007/0240645 | A1 | 10/2007 | Nomura et al. | |

FOREIGN PATENT DOCUMENTS

| | | |
|---|---|---|
| CN | 1593785 | 3/2005 |
| EP | 0796665 | 9/1997 |
| EP | 1566221 | 8/2005 |
| GB | 2414693 | 12/2005 |
| JP | 8 2861 | 1/1996 |
| JP | 8 52390 | 2/1996 |
| JP | 9 41 | 1/1997 |
| JP | 2000 317354 | 11/2000 |
| JP | 2000 317360 | 11/2000 |
| JP | 2002 192057 | 7/2002 |
| JP | 2004 275977 | 10/2004 |
| JP | 2005 87810 | 4/2005 |
| JP | 2005 87811 | 4/2005 |

OTHER PUBLICATIONS

English language Abstract of JP 2005-87811.
English language Abstract of JP 2002-192057.
English language Abstract of JP 2000-317354.
English language Abstract of JP 2000-317360.
English language Abstract of JP 8-52390.
English language Abstract of JP 2004-275977.
English language Abstract of EP 0796665.
English language Abstract of JP 9-41.
English language Abstract of JP 8-2861.
China Office action, mail date is Dec. 26, 2008.
Search report from E.P.O., mail date is Feb. 1, 2011.
Canada Office action, mail date is Aug. 25, 2011.

* cited by examiner

METHOD AND APPARATUS FOR FILLING COATING MATERIAL

TECHNICAL FIELD

The present invention concerns a method of filling a coating material by detaching a coating material filling tank having a soft and flexible coating material bag to be filled with a coating material from a coating machine and filling a coating material to the coating material bag, as well as a filling device used therefor.

BACKGROUND ART

In the coating for car bodies, paints using organic solvents are predominant and, with a view point of environmental protection and public pollution prevention, it has been demanded to decrease volatile organic solvents formed in a great amount in a coating step, and coating by aqueous paints has attracted attention as a countermeasure therefor.

For using an aqueous paint with minimum wasteful loss, while it is preferred to conduct coating by an electrostatic coating apparatus of high transfer efficiency, since the aqueous paint has low electric resistance and a rotary atomizing head of the electrostatic coating machine tends to be conducted electrically to the ground side by way of a paint flowing through a paint supply system, it is necessary to apply an insulation countermeasure over the paint supply system thereby preventing leakage of a high voltage at −60 to kV applied to the rotary atomizing head.

Therefore, it has been attempted so far not to leak high voltage even when it is applied to the coating machine by filling a paint from a paint supply system to a coating material filling tank formed in a coating machine or mounted detachably to the coating machine, and then extruding a paint from the filling tank in a state of physically disconnecting the paint supply system and the coating machine and conducting coating.

Patent Document 1: JP-A No. 2000-317354

Usually, in the electrostatic coating machine of this type, a bottom plate as a piston is slidably disposed along the inner peripheral surface of a coating material filling tank as a cylinder and the bottom plate is driven in forcively by other actuator or a liquid pressure to extrude the paint.

However, in this case, since the bottom plate and the inner peripheral surface have to be sealed reliably, friction is increased by so much to require a large driving force and the seal is abraded frictionally on every reciprocation of the bottom plate, a hydraulic fluid flows in a case of a liquid pressure driving to possibly give undesired effects on the paint quality.

Further, in a usual seal, since a plurality of O-rings are arranged in parallel to the outer peripheral surface of the bottom plate as a piston, paints intrude between an O-ring and another O-ring to cause a trouble that the bottom plate has to be detached and decomposed for cleaning upon cleaning after the completion of a day's work.

In view of the above, the present applicant has trially manufactured a coating material filling tank having a soft and flexible coating material bag to be filled with a coating material and conducting a coating experiment by detachably mounting the same to a coating machine having a coating material atomizing mechanism such as a rotary atomizing head.

In the coating material filling tank, a paint (coating material) is previously filled in the coating material bag and, when a hydraulic fluid is supplied at a metered amount to the outside thereof upon conducting coating, the coating material bag is squashed by the liquid pressure and the paint is extruded at a metered amount and supplied to the atomizing mechanism.

Accordingly, since there is no effect such as friction due to the O-rings, the pressure of the hydraulic fluid acts as it is on the coating material and the coating material can be supplied by a relatively small driving force to the atomizing mechanism.

Further, since the bottom plate as the piston is not used, there is no gap for intrusion of the coating material between the bottom plate and the coating material extruding chamber, cleaning can be conducted easily and coating failure was no more caused by insufficient cleaning or seal leakage of the bottom plate.

However, it has been found that bursting of the coating material bag or lack of paint during coating sometimes occurs during use of such coating material filling tank while repeating filling/extrusion of the paint.

Further, the filling amount of the paint to the paint bag is initially set to the amount of use plus for preventing lack of paint during coating. Theoretically, the filling amount of the paint does not exceed the amount of use plus $\alpha$, or is in short of the determined amount to be used upon starting the coating.

Actually, there may be an error, however, between the actual amount of use and the predetermined amount of use and, in a case where the actual amount of use is less than the predetermined amount of use, a surplus paint corresponding to the error is accumulated and when the bag is used in excess of the capacity thereof, the paint bag is burst.

Particularly, since the coating material bag tends to be worn by repetitive filling/discharging of the paint over and over, in a case where the coating material bag is formed of an extremely soft and flexible material in order to provide durability against filling/discharging, this results in a problem to lower the pressure resistance to the excess filling of the paint.

Further, in a case where the actual amount of use is more than the predetermined amount of use, a paint corresponding to the error is consumed and lack of paint sometimes occurs at the time that the paint which previously filled with a margin was exhausted.

DISCLOSURE OF THE INVENTION

Subject to be Solved by the Invention

In view of the above, it is a technical subject of the invention to prevent bursting of a coating bag or lack of paint during coating by accumulation of error between the filling amount and the amount of use even when the paint is filled/discharged repetitively to/from the paint bag.

Means for Solving the Subject

For solving the subject, the present invention provides a method of filling a coating material by detaching a coating material filling tank having a soft and flexible coating material bag to be filled with a coating material from a coating machine and filling the coating material to the coating material bag, which conducts a residual paint discharging step of supplying a hydraulic fluid to the outside of the coating material bag to squash the coating material bag by the pressure of supply and discharging the remaining coating material to empty the coating material bag before conducting a coating material filling step of supplying a predetermined amount of the coating material to the coating material bag.

EFFECT OF THE INVENTION

According to the method of filling the coating material of the invention, upon filling the coating material bag, the coating material remaining in the coating material is at first extruded to empty the bag and then a predetermined amount of the coating material is filled.

Accordingly, the amount of the coating material filled in the coating material bag is always constant irrespective of the amount of use upon starting the coating, so that the coating material bag is not burst due to the accumulation of the remaining paint, or the filling amount does not decrease to less than a required amount and lack of coating material does not occur.

BEST MODE FOR CARRYING OUT THE INVENTION

In this embodiment, the aim of preventing bursting of the material bag or lack of coating material during coating even when filling/discharging of the coating material to the coating material bag are repeated has been attained by filling a necessary amount of the coating material after emptying the coating material bag.

FIG. 1 to FIG. 3 are explanatory views showing a filing device and a filling method for a coating material according to the invention and FIG. 4 is an explanatory view showing an entire coating apparatus applied with the invention.

The coating apparatus 1 shown in FIG. 4 is adapted to conduct, for example, coating of car bodies being conveyed on a conveyor, in which a paint (coating material) filling tank C filled with a paint (coating material) for one step is mounted detachably to a coating machine (coating application machine) T attached to the top end of a weaving arm 3 of a coating robot 2, a paint in the paint filling tank C is extruded at a coating position $P_1$, which is atomized by an atomizing mechanism such as a rotary atomizing head H to coat a work such as a car body.

When the coating for a preceding work is completed, the coating machine T is moved to a transfer position $P_2$, the paint filling tank C after use is detached from the coating machine T and, at the same time, the inside of the coating machine T is cleaned, a standing-by paint filling tank C that has been filled with the paint is mounted to the coating machine T, and a succeeding work is coated again at the coating position $P_1$.

Meanwhile, the paint filling tank C after use is returned to a stocker (not illustrated), a paint filling tank C for a paint of succeeding color that coats the succeeding work is delivered out of the stocker, filled with a predetermined amount of a paint by a paint (coating material) filling device 4, and put to stand-by. Continuous coating can be conducted by repeating the procedures.

In the paint filling tank C, the inner surface is formed as a cylindrical inner peripheral surface, the outside of the paint (coating material) bag 5 disposed in the tank C is formed as a hydraulic fluid chamber 6, and the paint bag 5 is squashed by the liquid pressure of the hydraulic fluid supplied to the hydraulic fluid chamber 6 to extrude the coating material.

Further, a joint 7 is formed on the end face of the paint filling tank C connected with the coating machine T and the joint 7 is formed with a paint inlet/exit port 8 in communication with the coating bag 5, and a hydraulic fluid inlet/exit port 9 in communication with the hydraulic fluid chamber 6, and the ports 8, 9 are provided with stopper valves 11, 12 respectively which are closed excepting the case where the joint 7 is connected with the coating machine T or the filling attachment 10 of the paint filling device 4.

The coating material filling device 4 has a filing attachment 10 for connecting a coating material supply/discharge system 21 for supplying discharging the coating material to the paint bag 5 and, at the same time, connecting the hydraulic fluid supply/discharge system 22 for supplying/discharging the hydraulic fluid with the hydraulic fluid chamber 6.

The filling attachment 10 is formed with a paint port 23 and a hydraulic fluid port 24 connected with the paint inlet/exit port 8 and the hydraulic fluid inlet/exit port 9 of the paint filling tank C when the tank is set, and the paint port 23 is connected by way of a trigger valve TG to the coating material supply/discharge system 21, and the hydraulic fluid port 24 is connected by way of a hydraulic fluid valve DV to the hydraulic fluid supply/discharge system 22.

The coating material supply/discharge system 21 includes a color change device 25 provided integrally to the filling attachment 10, and respective color paint supply pipelines 26S, circulation pipelines 26R, cleaning liquid pipelines 26L, a cleaning air pipeline 26A, a waste liquid pipe 26W, etc, connected to the device.

The color change device 25 is provided with, color change valves $CV_1$ to $CV_5$ for selectively supplying respective color paints supplied from respective paint supply pipelines 26S and circulating them through the circulation pipelines 26R in a not selected state, a cleaning liquid valve LV, a cleaning air valve AV, and liquid waste valves $WV_1$, $WV_2$ to a manifold 27, and each of the valves is put to ON-OFF operation by an electric signal or air signal outputted from a valve control unit 28.

Each of the valves is connected to a paint flow channel 29 formed in the manifold 27 of the color change device 25, the trigger valve TG is disposed at the top end thereof, the cleaning liquid valve LV, the cleaning air valve AV, and the liquid waste valve $WV_1$ are disposed at the rear end thereof, and color change valves $CV_1$ to $CV_4$ for respective color paints are disposed in the midway.

With the constitution described above, when the paint extruded by the hydraulic fluid is discharged through the paint channel 29 and from the liquid waste valve $WV_1$ disposed at the rear end thereof, the preceding color paint remaining in the paint channel 29 is extruded and the paint channel 29 is filled with a current color paint.

Accordingly, the preceding color paint and the current color paint are not mixed in the color change device 25 without color change cleaning on every color change, and the amount of use of the cleaning liquid can be decreased remarkably.

Particularly, since aqueous paints are less mixed to each other, a high cleaning effect can be obtained only by extruding the preceding color by the current color paint.

Further, in the manifold 27, a liquid waste channel 30 from the trigger valve TG to another liquid waste valve $WV_2$ is formed and, when the inside of the color change device 25 is cleaned after completion of the day's work, the inside of the paint channel 29 is cleaned by the cleaning liquid and the cleaning air supplied from the cleaning liquid valve LV and the cleaning air valve AV, and they are discharged through the liquid waste channel 30 from the liquid waste valve $WV_2$.

The hydraulic fluid supply/discharge system 22 has a pressure sensor 31 for detecting that the paint bag 5 is emptied when the hydraulic fluid is supplied to the paint filling tank C set to the filling attachment 10 to extrude the coating material remaining in the paint bag 5 by the pressure of supply of the hydraulic fluid, and has a metering cylinder 32 that detects the filling amount of the paint in the coating bag 5 based on the amount of the hydraulic fluid extruded from the hydraulic fluid chamber 6 when the filling of the coating material is started after emptying the paint bag 5.

The metering cylinder 32 is provided with a position sensor 34 such as a linear encoder or a rotary encoder that detects the position of the piston 33, and the liquid amount is calculated by a valve control unit 28 based on the detected piston position.

Further, also the pressure sensor 31 is connected to the valve control unit 28 and, since the pressure increases abruptly when the paint bag 5 is squashed completely into the empty state, it can be detected whether the paint bag 5 is emptied or not by monitoring the pressure.

Further, a breakage detection means 35 for detecting the breakage of the paint bag 5 by measuring a light permeability or electric conductivity of the hydraulic fluid that changes by the mixing of the paint in the hydraulic fluid, and a channel switching valve 36 for closing the flow channel to the cylinder 32 and opening the drain side when the paint bag 5 is burst are intervened in the hydraulic fluid pipeline DP from the hydraulic fluid valve DV to the cylinder 32.

An example of the constitution of the present invention is as has been described above and the method of the invention is to be described.

In the method of the invention, in a case of detaching the paint filling tank C from the coating machine T after completion of the coating and filling the paint to the paint bag 5, a residual coating material discharge step of supplying the hydraulic fluid into the hydraulic fluid chamber 6 at the outside of the coating material bag 5 and squashing the coating material bag 5 by the pressure of supply thereby extruding the remaining coating material to empty the coating material bag 5 is conducted before conducting a coating material filling step of supplying a predetermined amount of paint to the coating material bag 5.

That is, the coating material filling step is conducted after conducting the remaining coating material discharge step.

When the paint filling tank C to be filled with the paint is set to the filling attachment 10 after cleaning, the position $X_1$ for the piston 33 of the metering cylinder 32 at that instance is stored in the control unit 28.

Then, the residual coating material discharge step shown in FIG. 1 is conducted.

In the remaining coating material discharge step, when the hydraulic fluid is supplied from the metering cylinder 32 by opening the hydraulic fluid valve DV, the trigger valve TG, and the waste liquid valve $WV_1$, the paint bag 5 is squashed by the pressure of supply of the hydraulic fluid flowing into the hydraulic fluid chamber 6, and the paint remaining in the paint bag 5 is discharged passing from the trigger valve TG through the paint channel 29 in the manifold 27, and through the liquid waste valve $WV_1$.

Thus, the preceding color paint remaining in the paint channel 29 in the color change device 25 is cleaned off and the inside of the paint channel 29 is filled with a current color paint (paint of a color identical with that of the paint supplied to the paint filling tank C) discharged from the paint bag 5.

Particularly, in a case of coating by aqueous paints, since the aqueous paints are less mixed to each other, when an aqueous paint of a preceding color remaining in the paint channel 29 is extruded by an aqueous paint of a current color, the preceding color paint is thoroughly cleaned off with no color residue, so that color change cleaning by the cleaning liquid and the cleaning air is no more necessary and the amount of the cleaning liquid to be used is decreased remarkably.

Then, as shown in FIG. 2, when the paint bag 5 is completely squashed into an empty state, since the pressure of supply of the hydraulic fluid flowing into the hydraulic fluid chamber 6 increases abruptly, the change of pressure is monitored by the pressure sensor 31, the position $X_2$ for the piston 33 at the instance the pressure reaches a predetermined value is stored in the control unit 28, the supply of the hydraulic fluid from the metering cylinder 32 is stopped and, simultaneously, the hydraulic fluid value DV, the trigger valve TG, and the liquid waste valve $WV_1$ are closed.

Then, the coating material filling step shown in FIG. 3 is conducted.

In the coating material filling step, when the color change valve $CV_1$ for the paint supplied to the paint filling tank C, the trigger valve TG, and the hydraulic fluid valve DV are opened, the paint is filled from the color change valve $CV_1$ by way of the trigger valve TG to the paint bag 5 and, correspondingly, the hydraulic fluid is discharged form the hydraulic fluid chamber 6 of the paint filling tank C and caused to flow into the measuring cylinder 32.

That is, the filling amount of the paint in the paint bag 5 and the discharging amount of the hydraulic fluid from the hydraulic fluid chamber 6 are equal and, accordingly, the flowing amount of the hydraulic fluid to the measuring cylinder 32 is equal with the filling amount of the paint of the paint bag 5.

In this case, in the control unit 28, the position $X_3$ for the piston 33 displacing from the piston position $X_2$ at the instance the paint bag 5 is emptied is monitored by the position sensor 34 and the flowing amount of the hydraulic fluid is calculated successively.

That is, assuming the cross sectional area for the measuring cylinder 32 as S, the in-flow amount Q is calculated as:

$$Q=X(X_3-X_2)$$

Then, at the instance the calculated flow-in amount Q reaches a predetermined filling amount of the paint to be filled in the coating bag 5, the color change valve $CV_1$, the trigger valve TG, and the hydraulic fluid valve DV are closed to complete the filling of the paint to the paint filling tank C.

Then, since an appropriate amount of the paint is filled after once eliminating the paint remaining in the paint bag 2, when the paint filling tank C completed with the filling of the paint is mounted to the coating machine T and coating is conducted, even if the procedures are repeated by a number of times, this does not cause bursting of the paint bag 5 due to accumulation of a surplus paint or lack of paint due to the excess amount of the paint used.

INDUSTRIAL APPLICABILITY

As has been described above, the present invention is applicable to an application use of filling a coating material to a coating material filling tank mounted detachably to a coating machine in a case of conducting coating by using an aqueous paint or conductive paint particularly.

Figure 1:
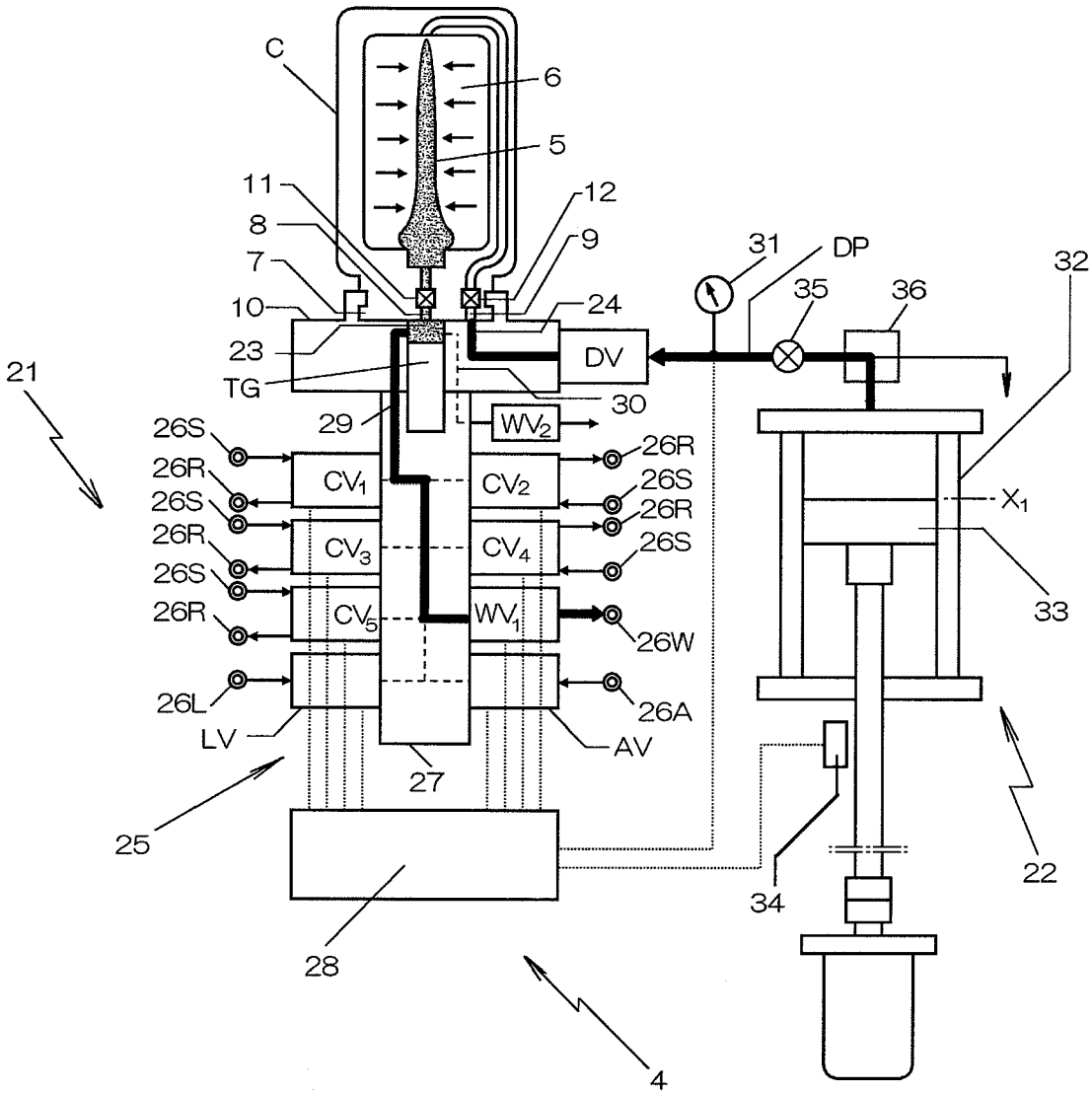
FIG. 1 is an explanatory view showing a coating material filling device and a method therefor according to the invention.
Figure 2:
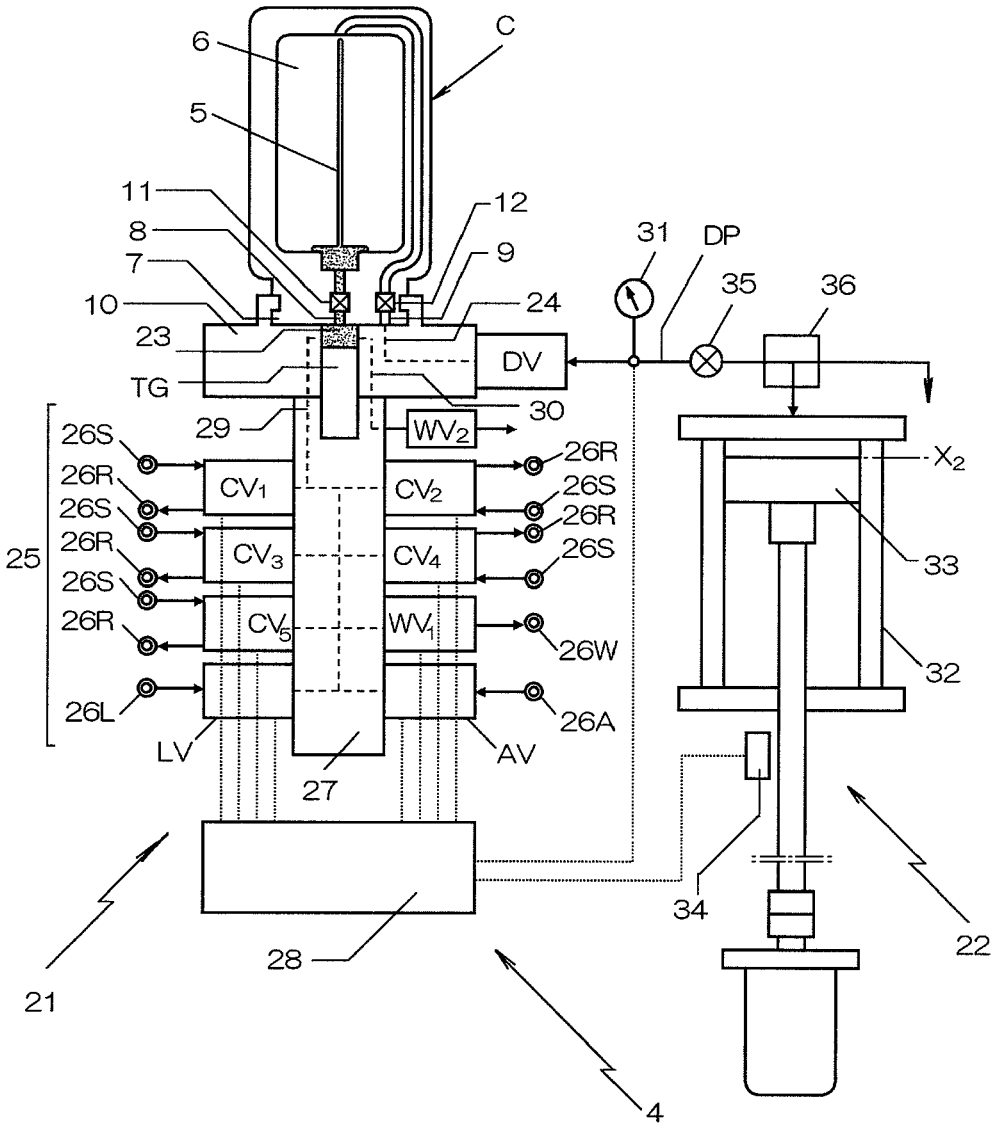
FIG. 2 is an explanatory view showing a coating material filling device and a method therefor according to the invention.
Figure 3:
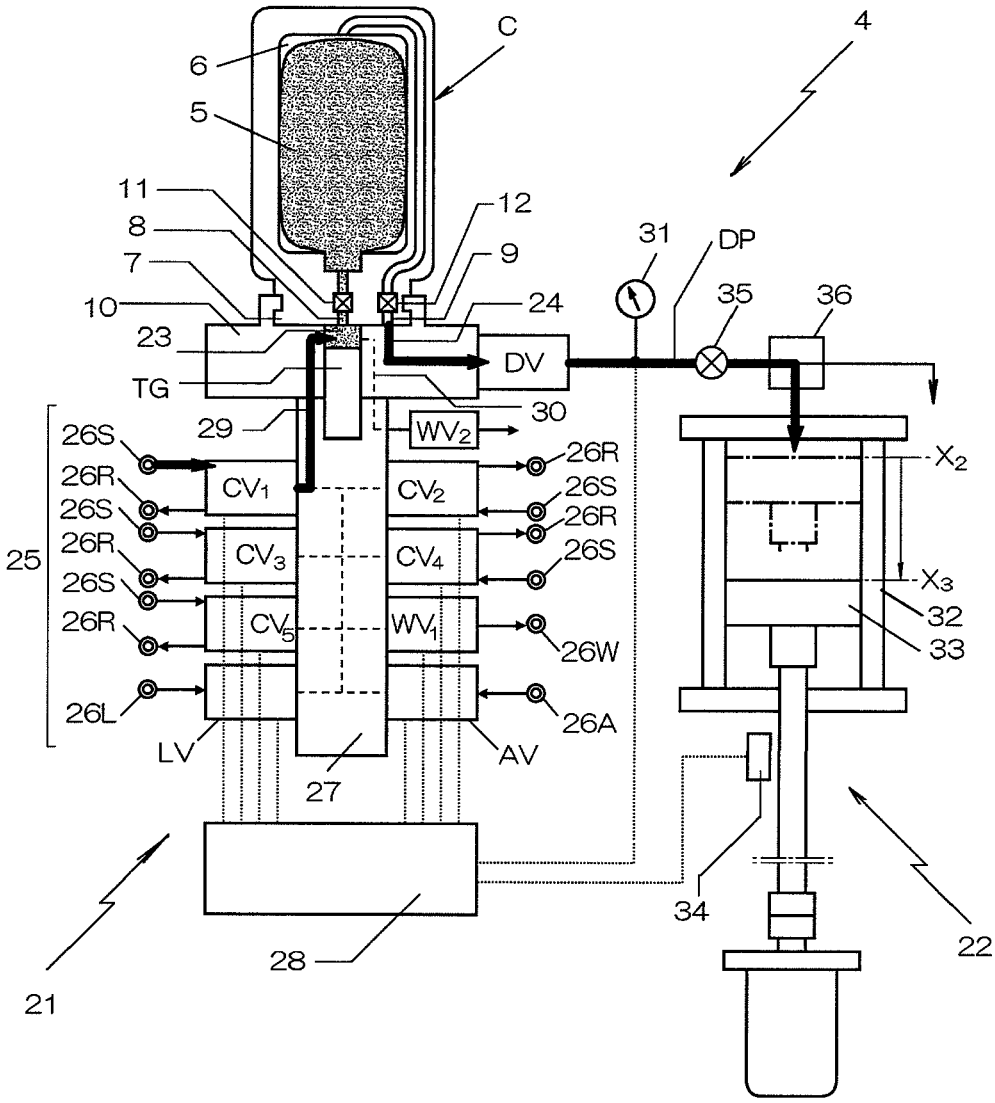
FIG. 3 is an explanatory view showing a coating material filling device and a method therefor according to the invention.
Figure 4:
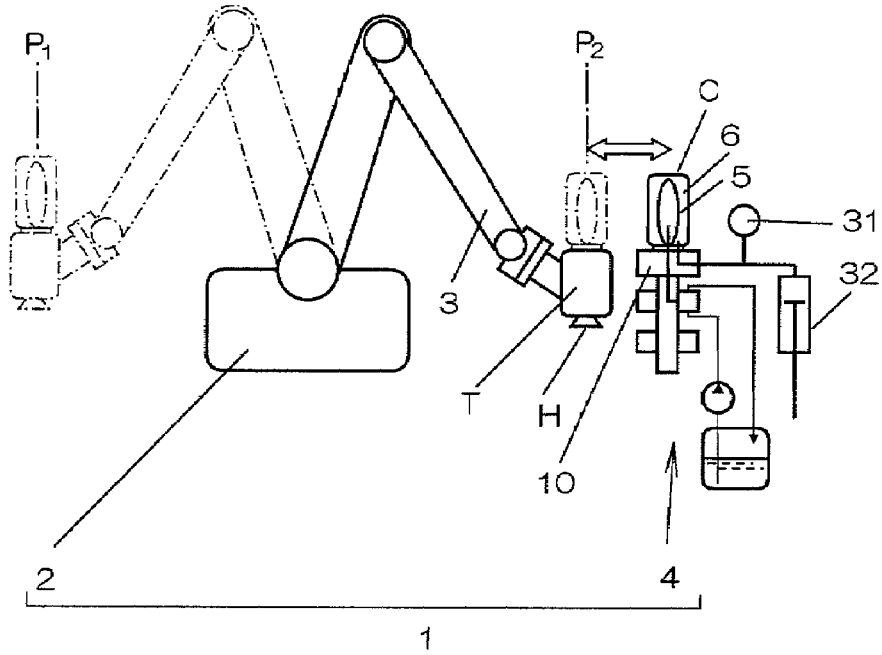
FIG. 4 is an explanatory view showing the entire coating apparatus.

| Description for References | |
|---|---|
| T | coating machine (coating application machine) |
| C | paint (coating material) filling tank |
| 4 | paint (coating material) filling device |
| 5 | paint (coating material) bag |
| 6 | hydraulic fluid chamber |
| 10 | attachment |
| 21 | coating material supply/discharge system |
| 22 | hydraulic fluid supply/discharge system |
| 31 | pressure sensor |
| 32 | metering cylinder |

The invention claimed is:

1. A method of filling a coating material by detaching a coating material filling tank having a soft and flexible coating material bag to be filled with a coating material from a coating machine and filling the coating material to the coating material bag, which includes discharging remaining coating material by supplying a hydraulic fluid to the outside of the coating material bag, squashing the coating material bag by the pressure of supply, extruding the remaining coating material to empty the coating material bag, then, filling coating material by supplying a predetermined amount of the coating material to the coating material bag, and during the coating material filling, detecting a burst of the coating material bag based on a change of a physical property of the hydraulic fluid extruded from a hydraulic fluid tank.

2. The coating material filling method according to claim 1, wherein an empty state of the coating material bag is detected based on the pressure of supply of the hydraulic fluid during the remaining coating material discharging.

3. The coating material filling method according to claim 1, wherein the coating material filling amount in the coating material bag is detected based on the extrusion amount of the hydraulic fluid extruded from the hydraulic fluid tank along with filling of the coating material during the coating material filling.

4. The coating material filling method according to claim 3, wherein the hydraulic fluid is caused to flow into a measuring cylinder and the extrusion amount of the hydraulic fluid is detected by the position of the piston thereof.

5. The coating material filling method according to claim 1, wherein in a case of supplying an optional paint selectively from paints of plural colors by a color exchanger during the coating material filling, a preceding color paint remaining in the color exchanger is cleaned off by a discharged paint extruded by the hydraulic fluid during the remaining coating material discharging and the flow channel of the color exchanger is filled with the discharge paint.

6. A device for filling a coating material by detaching a coating material filling tank having a soft and flexible coating material bag to be filled with a coating material from a coating machine and filling the coating material to the coating material bag including;

a coating material filling attachment that connects a coating material supply/discharge system that supplies/discharges a coating material, and a hydraulic fluid supply/discharge system that supplies/discharges a hydraulic fluid to the coating material filling tank, the hydraulic fluid supply/discharge system includes a pressure sensor that detects that the coating material bag is emptied by supplying the hydraulic fluid to the outside of the coating material bag and extruding the coating material remaining in the coating material bag by the pressure of supply of the hydraulic fluid, and a metering cylinder that detects the filling amount of the coating material filled in the coating material bag based on the amount of the hydraulic fluid extruded from a hydraulic fluid tank along with filling of the coating material to be started after emptying the coating material bag, and a detector that detects a burst of the coating material bag during coating material filling based on a change of a physical property of the hydraulic fluid extruded from the hydraulic fluid tank.

7. The coating material filling device according to claim 6, wherein the coating material supply/discharge system has a color exchanger that selectively supplies an optional paint among paints of plural colors, and the color exchanger is connected with the coating material filling attachment.

8. The coating material filling device according to claim 6, wherein a paint channel formed in a color exchanger is connected at the top end thereof with the coating material tank, and provided at the rear end thereof with a cleaning fluid valve and liquid waste valve, and color change valves for respective colors are is disposed in the midway thereof.

* * * * *